US005741065A

United States Patent [19]

Bell et al.

[11] Patent Number: 5,741,065

[45] Date of Patent: Apr. 21, 1998

[54] CLEANING SYSTEM AND METHODS FOR A MIXING TRUCK

[76] Inventors: Foyster G. Bell, P.O. Box 418, Duchesne, Utah 84021; William A. Strand, 4364 Fresno Dr., Las Vegas, Nev. 89120

[21] Appl. No.: 652,772

[22] Filed: May 23, 1996

[51] Int. Cl.[6] ..... B28C 5/18; B28C 7/04

[52] U.S. Cl. ..... 366/541; 366/349; 366/41

[58] Field of Search ..... 366/53, 54, 68, 366/41, 349; 414/409

[56] References Cited

U.S. PATENT DOCUMENTS

| | | | |
|---|---|---|---|
| 2,808,947 | 10/1957 | Shippy | 414/409 |
| 4,199,161 | 4/1980 | Niemien et al. | 280/8 |
| 5,007,786 | 4/1991 | Bingman et al. | 414/409 |
| 5,049,026 | 9/1991 | Bingman et al. | 414/409 |
| 5,127,740 | 7/1992 | DeBoer | 366/54 |
| 5,205,698 | 4/1993 | Mezey | 414/409 |
| 5,344,273 | 9/1994 | Radlein | 414/409 |

FOREIGN PATENT DOCUMENTS

| | | | |
|---|---|---|---|
| 3828845 | 3/1990 | Germany | 414/409 |

*Primary Examiner*—Tony G. Soohoo

*Attorney, Agent, or Firm*—Townsend and Townsend and Crew LLP

[57] ABSTRACT

The invention provides systems, methods and apparatus for cleaning a mixing truck by removing and recycling any non-delivered material. In one exemplary system, the invention is preferably attached to a mixing truck having at least one delivery chute and a loading hopper. A rail is configured to be attached to the mixing truck so that the bottom end is near a ground surface and the top end is near the loading hopper. The system further comprises a canister that is movable between the delivery chute and the rail. A lifting mechanism is movably attached to the rail and includes a securing device so that the lifting mechanism may secure and transport the canister along the rail. In this manner, material remaining in the delivery chute may be washed into the canister when positioned below the chute. The canister may then be moved near the rail and secured to the lifting mechanism which in turn transports the canister to the loading hopper where the contents may be emptied.

11 Claims, 9 Drawing Sheets

CLEANING SYSTEM AND METHODS FOR A MIXING TRUCK

BACKGROUND OF THE INVENTION

This invention relates generally to the field of mixing trucks, such as cement trucks. More particularly, the invention relates to systems, methods, and apparatus for washing residual material from the truck after a delivery operation, such as by removing the material from a delivery chute and returning it to a loading hopper for reuse.

Mixing trucks are widely used for a variety of applications, most commonly for mixing and delivering cement. Typical operation of a mixing truck begins by loading the truck with a given type of materials usually by depositing the material into a rotating drum via a loading hopper. After loading, the truck is driven to a construction site, where the delivery chute is positioned at a desired location. The chute is placed at a downward angle so that the material may flow down and out of the chute. After the delivery process, the delivery chute usually contains residual material which needs to be removed to keep the truck in good working order.

Environmentally friendly and cost efficient systems for cleaning such mixing trucks have become increasingly desirable, especially as it becomes more and more unacceptable to dump the residual material outside of a prescribed land fill. Various systems for ridding residual material from mixing trucks have been proposed, including washing the material directly onto the ground, emptying the material into containers for remote disposal and washing the material directly into a sewage system.

These methods are all undesirable in that they pose various environmental and practical problems. For example, washing waste material directly onto the ground, particularly when the waste is cementitious, can harm the ecosystem. It also creates an unsightly mess. Emptying the material into containers for remote disposal is costly, time consuming and is an environmental burden on the ultimate disposal site. Washing the material directly into a sewage system causes similar environmental problems. For example, it can increase the burden on the sewage system and may stenose or occlude the system.

It therefore would be desirable to provide environmentally sound and economically practical systems, methods and apparatus which would greatly reduce or eliminate the drawbacks of previously proposed systems. It would be particularly desirable if such systems, methods and apparatus were able to recycle any residual material so that it may be recovered and reused.

SUMMARY OF THE INVENTION

The present invention provides systems, methods and apparatus for cleaning a mixing truck by removing and recycling any non-delivered material. Although useful with a variety of mixing trucks, the invention will find its greatest use with cement trucks which deliver cement to a delivery site via a cement delivery chute. The invention provides systems, methods and apparatus for removing any accumulated cement from the chute and recycling it back to the truck's drum.

A system according to the present invention will preferably be attached to a mixing truck having at least one delivery chute and a loading hopper. The system comprises a rail having a top end and a bottom end. The rail is configured to be attached to the mixing truck so that the bottom end is near a ground surface and the top end is near the loading hopper. The system further comprises a canister that is movable between the delivery chute and the rail. A lifting mechanism is movably attached to the rail and includes a securing device so that the lifting mechanism may secure and transport the canister along the rail. In this manner, material remaining in the delivery chute may be washed into the canister when positioned below the chute. The canister may then be moved near the rail and secured to the lifting mechanism which in turn transports the canister to the loading hopper where the contents may be emptied.

The lifting mechanism may be powered either electrically, hydraulically or pneumatically. In another exemplary aspect, the system further comprises a safety cable having a first end and a second end. The first end is adapted for attachment to the mixing truck and the second end is affixed to the canister. In this way, the safety cable will prevent the canister from drifting from the mixing truck.

In another exemplary aspect of the system, the canister includes a plurality of wheels attached to the bottom end so that the canister can be rolled between the delivery chute and the rail. In yet another aspect, the securing apparatus comprises two arms which may be conveniently used to secure the canister. In still a further aspect, the rail will preferably be vertically oriented when attached to the mixing truck.

The invention further provides for a mixing truck having an exemplary cleaning system. The mixing truck includes a chassis, a mixing drum that is operably attached to the chassis, a loading hopper that is operably attached to the mixing drum, and a delivery chute that extends from an open back end of the mixing truck. The mixing truck further includes a rail having a top end and a bottom end. The rail is attached to the mixing truck such that the bottom end is near a ground surface and the top end is near the loading hopper. A canister is provided and is movable between the delivery chute and the rail. The truck further includes a lifting mechanism that is movably attached to the rail. The lifting mechanism has a securing device so that the lifting mechanism may secure and transport the canister along the rail. In this way, the canister may be transported to the top of the rail where its contents will fall into the loading hopper.

The system provides an exemplary method for cleaning residual material from a mixing truck. According to the method, a canister is placed near the delivery chute to receive material that is washed from a delivery chute. After the canister receives the material, it is moved from the delivery chute to a lifting mechanism that is movable along the rail which is attached to the truck. The canister is secured to the lifting mechanism and transported to the top of the rail where the contents are dumped into the truck's loading hopper.

In one preferable aspect, the top end of the rail is curved so that the contents of the canister will fall into the loading hopper upon reaching the top end of the rail. In another preferable aspect, the canister has an open top end and a plurality of wheels attached to the bottom end. In this way, the canister may receive residual material from the delivery chute and be rolled to and from the rail.

Hence, the present invention provides an environmentally friendly and economical way to recover residual material from a mixing truck. For a further understanding of the nature and advantages of the present invention, reference is made to the ensuing specification and attached drawings.

DETAILED DESCRIPTION OF THE SPECIFIC EMBODIMENTS

The invention provides systems, methods, and apparatus for cleaning and recycling residual material from delivery trucks, typically mixing trucks such as cement trucks and the like. For convenience of discussion, the cleaning and recycling system of the invention will be described with reference to mixing trucks used for mixing and delivering cementitious material. However, it will be understood that the invention may be useful with other types of delivery trucks and materials.

Figure 1:
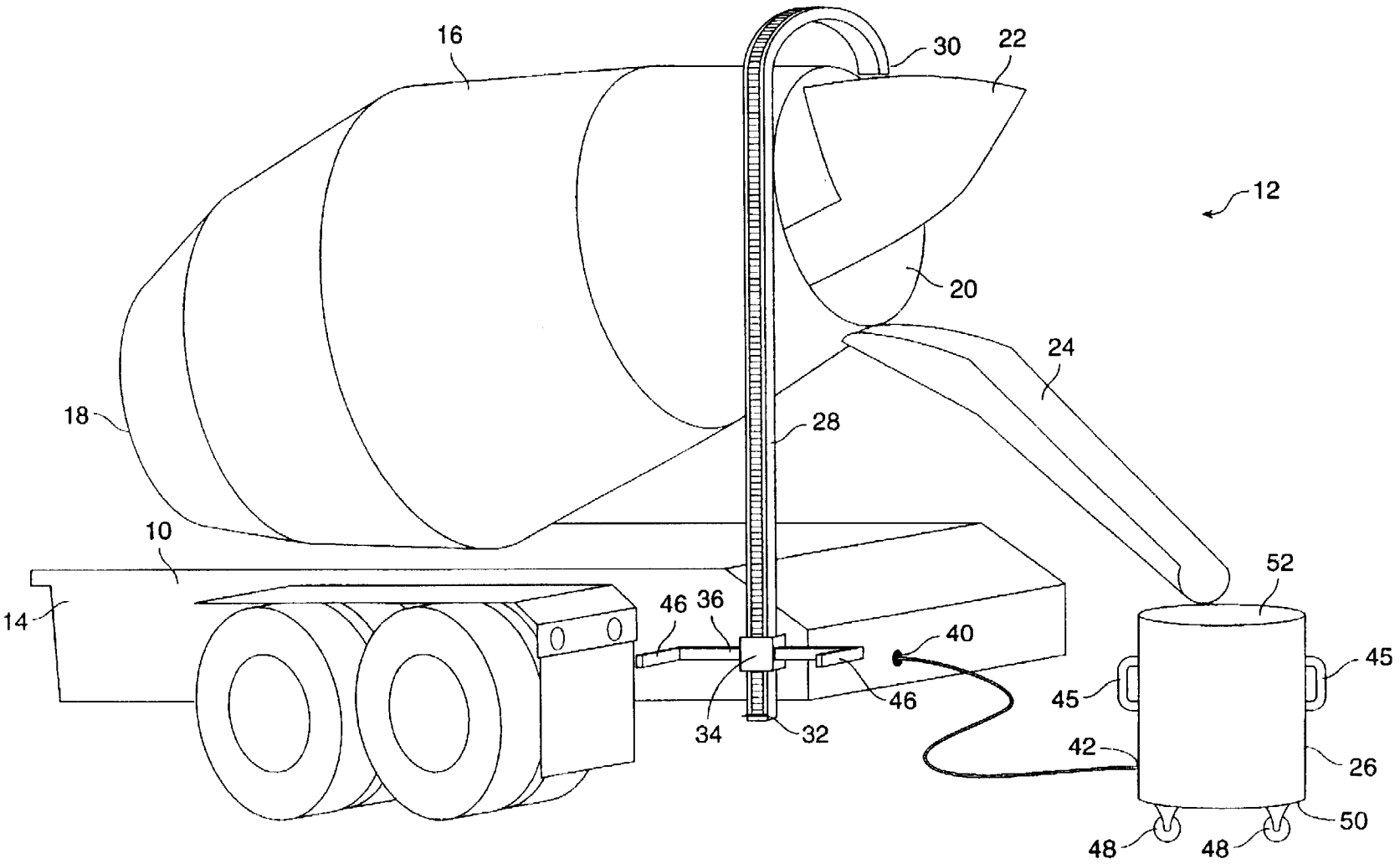
FIG. 1 is a perspective view of a back end of a mixing truck having an exemplary cleaning system which includes a canister positioned at the bottom end of a delivery chute according to the present invention.
Figure 2:
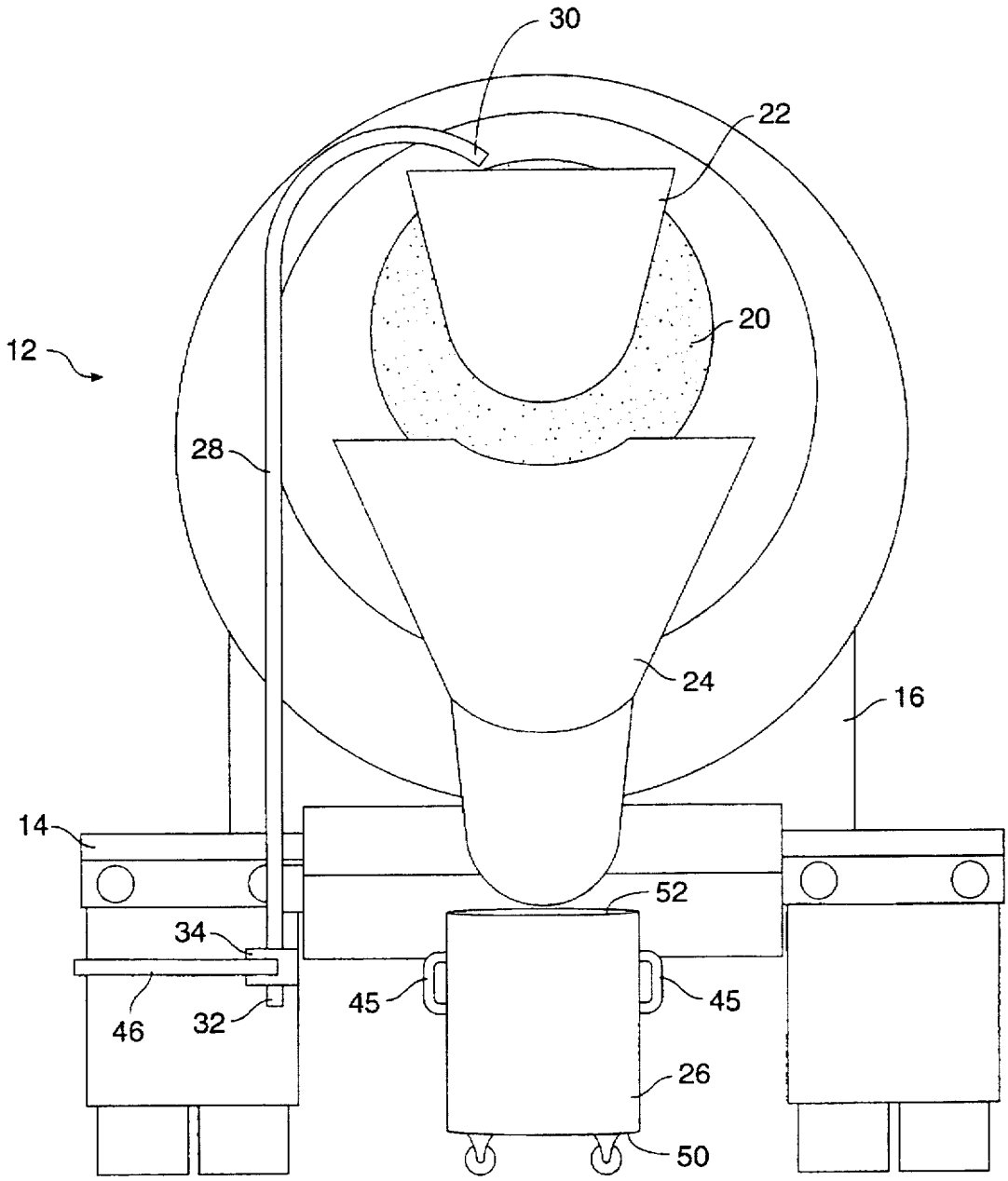
FIG. 2 is a rear view of the mixing truck of FIG. 1.

Referring now to FIGS. 1 and 2, a mixing truck 10 having an exemplary cleaning system 12 will be described. Truck 10 comprises a chassis 14 and a mixing drum 16 having a front end 18 and an open back end 20. Mixing drum 16 is operably attached to chassis 14 as is known in the art. A loading hopper 22 is operably attached to back end 20 of mixing drum 16 and functions as a receptacle for delivering cementitious material (not shown) into mixing drum 16. Delivery chute 24 is positioned to receive cementitious material from back end 20. Chute 24 is movable so that it may be positioned to deliver cementitious material to a desired location. As shown, chute 24 extends downwardly from open back end 20 so that cementitious material may flow down delivery chute 24.

System 12 further includes a canister 26 for receiving cementitious material from delivery chute 24. Following delivery of material from truck 10, canister 26 may be positioned below chute 24 so that any residual material in chute 24 may be washed into canister 26. Removal of the residual material is best accomplished by spraying water down chute 24 and by pushing (as with a shovel) any large accumulation downwards and into canister 26.

Figure 8:
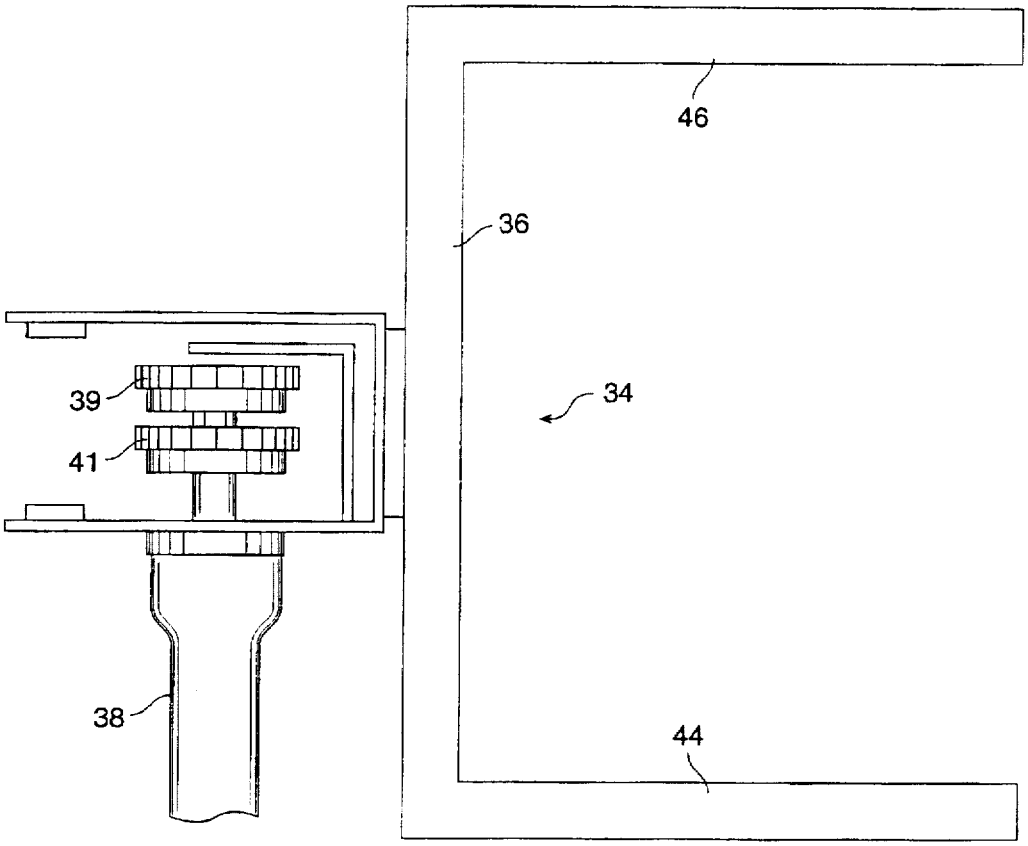
FIG. 8 is a bottom view of the lifting mechanism of FIG. 7.

Cleaning system 12 further includes a rail 28 having a top end 30 and a bottom end 32. Rail 28 is attached to mixing truck 10 such that bottom end 32 is near a ground surface and top end 30 is near loading hopper 22. As shown in FIG. 2, movably attached to rail 28 is a lifting mechanism 34. Lifting mechanism 34 includes a securing device 36 (as shown in FIG. 8) that may secure canister 26 to rail 28. In this way, canister 26 may be lifted and transported along rail 28.

Referring to FIG. 8, lifting mechanism 34 will be described in greater detail. As shown, securing device 36 includes a right securing arm 44 and a left securing arm 46. Securing arms 44, 46 are received into slots 45 in canister 26 (see FIG. 1) to attach canister 26 to securing device 36.

Figure 9:
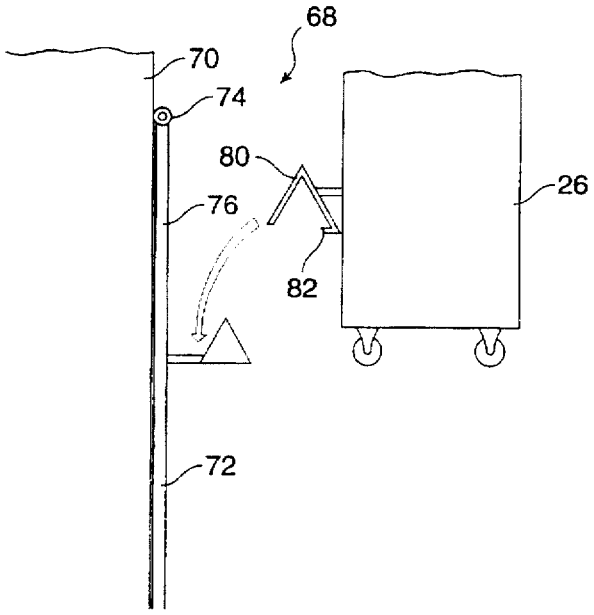
FIG. 9 is a side view of an alternative lifting mechanism according to the present invention.
Figure 10:
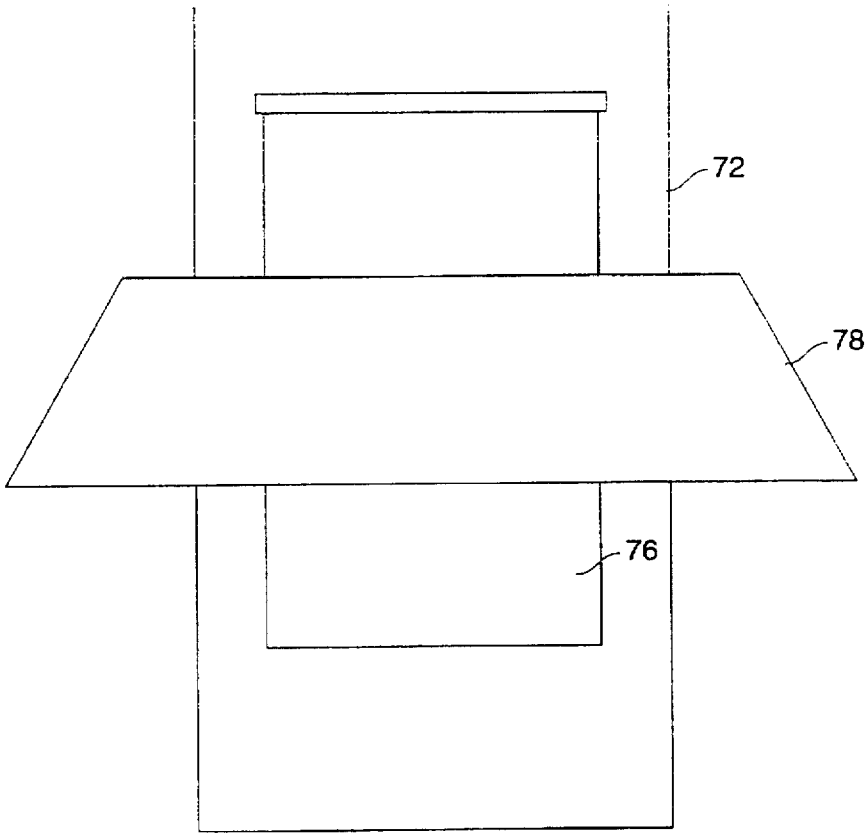
FIG. 10 is a front view of the lifting mechanism of FIG. 9.
Figure 11:
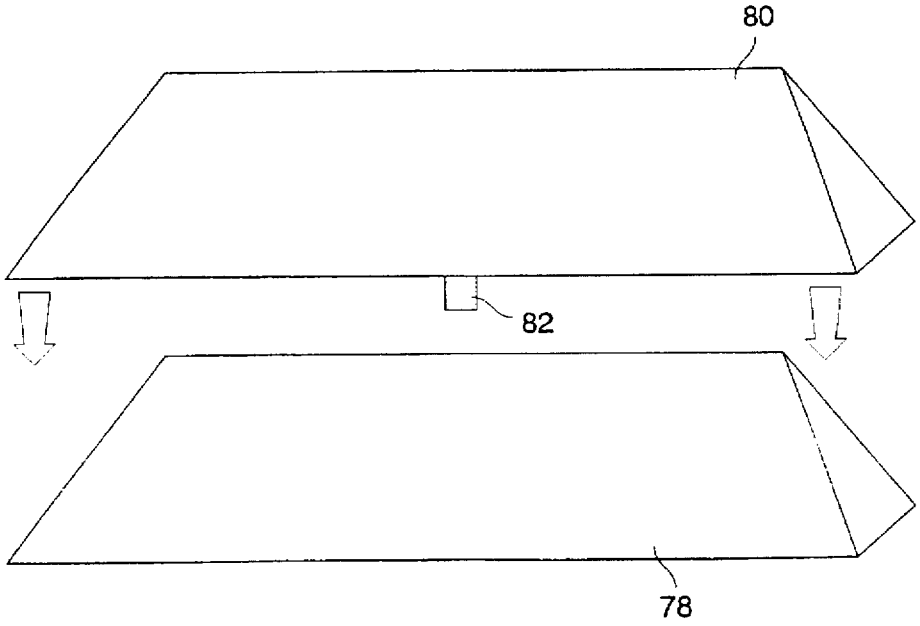
FIG. 11 is a detailed view of a taper lock lift arm of the lifting mechanism of FIG. 9.

Although shown with a pair of arms, it will be appreciated that other securing devices may be employed to secure canister 26 to lifting mechanism 34. For example, FIGS. 9–11 illustrate an alternative lifting mechanism 68. Lifting mechanism 68 includes a lift trolley 70 (which is attached to a side of the truck similar to rail 28) having a belt 72 which moves around a pulley 74. Attached to belt 72 by a mounting plate 76 (see FIG. 10) is a taper lock lift arm 78. Canister 26 is modified to include a tapered catch 80 which is configured to mate with lift arm 78. Just below tapered catch 80 is a latch 82 which is biased outward similar to a conventional door latch. As lift arm 78 is mated with catch 80, latch 82 moves into a receiving hole (not shown) in lift arm 78 to secure lift arm 78 to catch 80. Latch 82 may be released by a cable (not shown) which pulls latch 82 from its receiving hole.

Lifting mechanism 68 operates by rolling canister 26 along the ground until catch 80 is generally aligned over lift arm 78. Belt 72 is then translated to raise lift arm 78 until it is received into catch 80. The tapered nature of catch 80 assists in helping lift arm 78 to be received into and mate with catch 80 so that latch arm 82 may lock in place. Although not shown, lift trolley 70 will preferably be curved (similar to rail 28) so that canister 26 may be emptied as described hereinafter with reference to FIGS. 4–6.

Referring back to FIG. 8, lifting mechanism 34 is powered by an electrical motor 38. Motor 38 rotates a pair of gears 39, 41 which engage rail 28 to move lifting mechanism 34 as described in greater detail hereinafter. Although shown with a electrical motor 38, other power sources may alternatively be employed including a hydraulic power source, a pneumatic power source, or the like.

Referring back to FIG. 1, system 12 may optionally include a safety cable 38. Safety cable 38 comprises a first end 40 which is attached to mixing truck 10 and a second end 42 which is affixed to canister 26. In this way, safety cable 38 may be employed to prevent canister 26 from drifting from mixing truck 10.

Still referring to FIG. 1, canister 26 may optionally include a plurality of wheels 48 attached to a bottom end 50. In this way, canister 26 may be rolled from delivery chute 24 to bottom end 32 of rail 28. Canister 26 further includes an open top end 52 so that cementitious material may be washed into canister 26 from delivery chute 24.

Referring now to FIGS. 1–5, an exemplary method for cleaning and recycling material from a mixing truck using system 12 will be described. Initially, canister 26 is positioned near delivery chute 24 as illustrated in FIGS. 1 and 2 so that residual material may be washed out of chute 24 and deposited into open top end 52 of canister 26.

Figure 3:
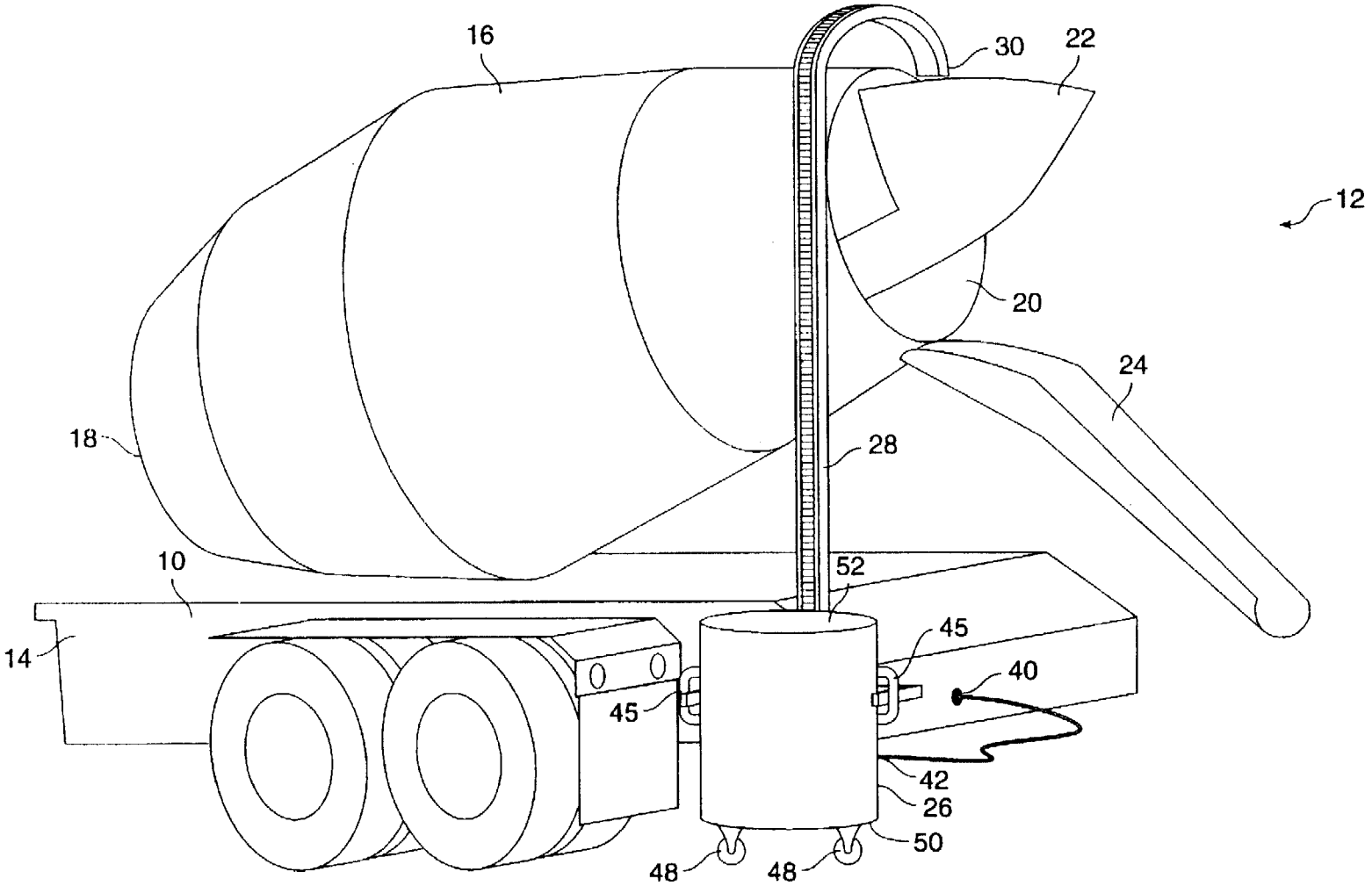
FIG. 3 illustrates the mixing truck of FIG. 1 having the canister positioned at a bottom end of a rail.

Canister 26 is then rolled from delivery chute 24 to bottom end 32 of rail 28 as shown in FIG. 3. To load canister onto lifting mechanism 34, slots 45 are aligned with arms 44, 46 and canister is rolled toward truck 10 until arms 44, 46 are received into slots 45.

Figure 7:
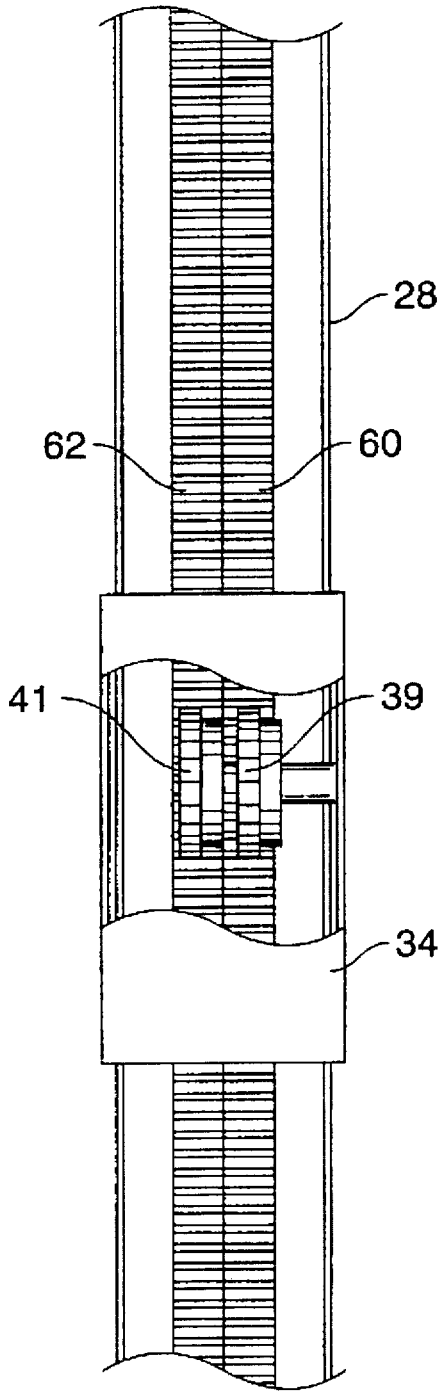
FIG. 7 is a front view of a section of the rail of FIG. 6 attached to a lifting mechanism according to the present invention.

After canister 26 is secured to lifting mechanism 34, motor 38 is actuated to move lifting mechanism 34 along rail 28 to top end 30. Travel of lifting mechanism 34 along rail 28 is best shown in FIG. 7. Rail 28 includes a pair of racks 60, 62 into which gears 39, 41 mesh. As gears 39, 41 rotate, lifting mechanism 34 is moved up and down rail 28.

Figure 4:
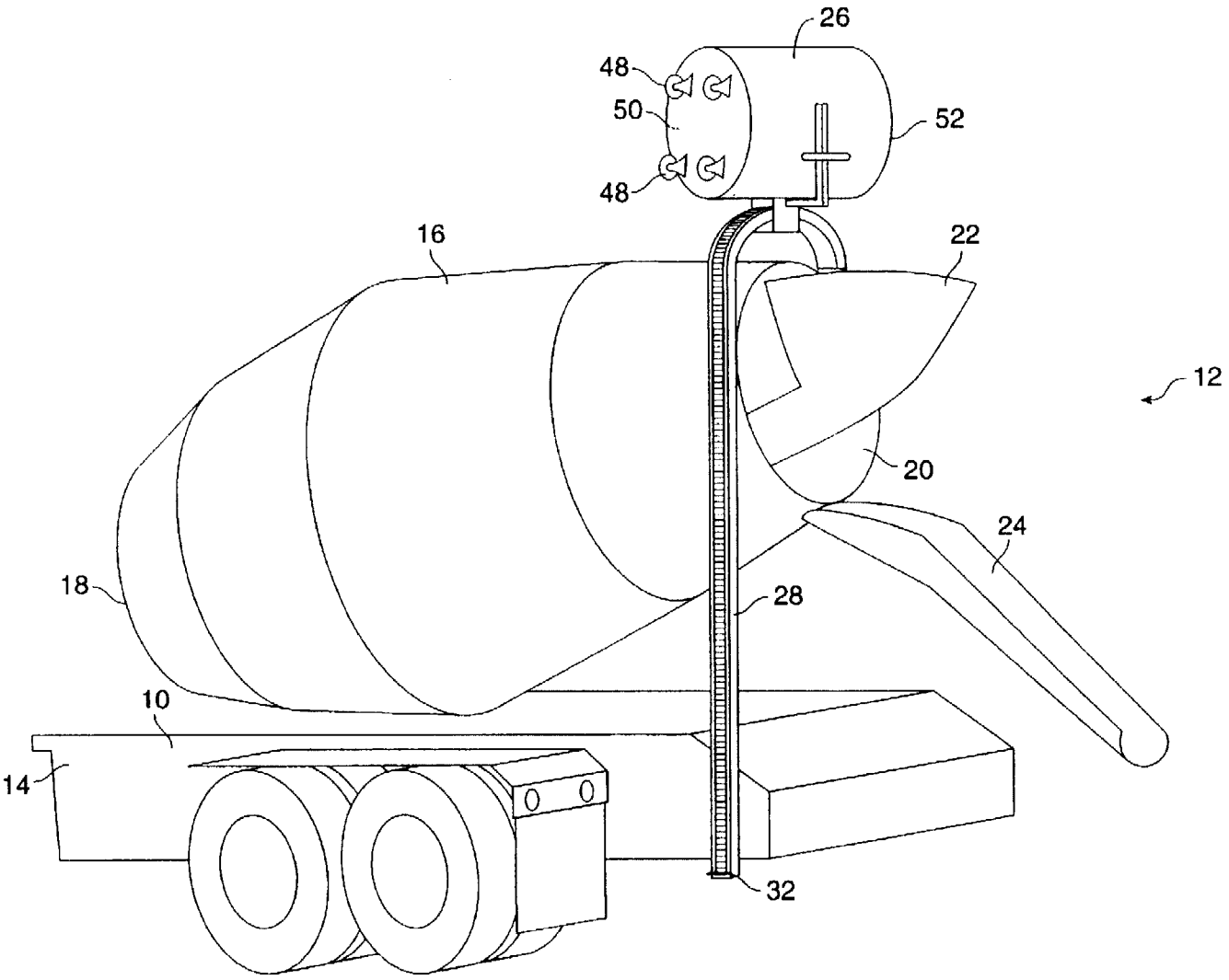
FIG. 4 illustrates the mixing truck of FIG. 1 having the canister positioned at a top end of the rail.
Figure 5:
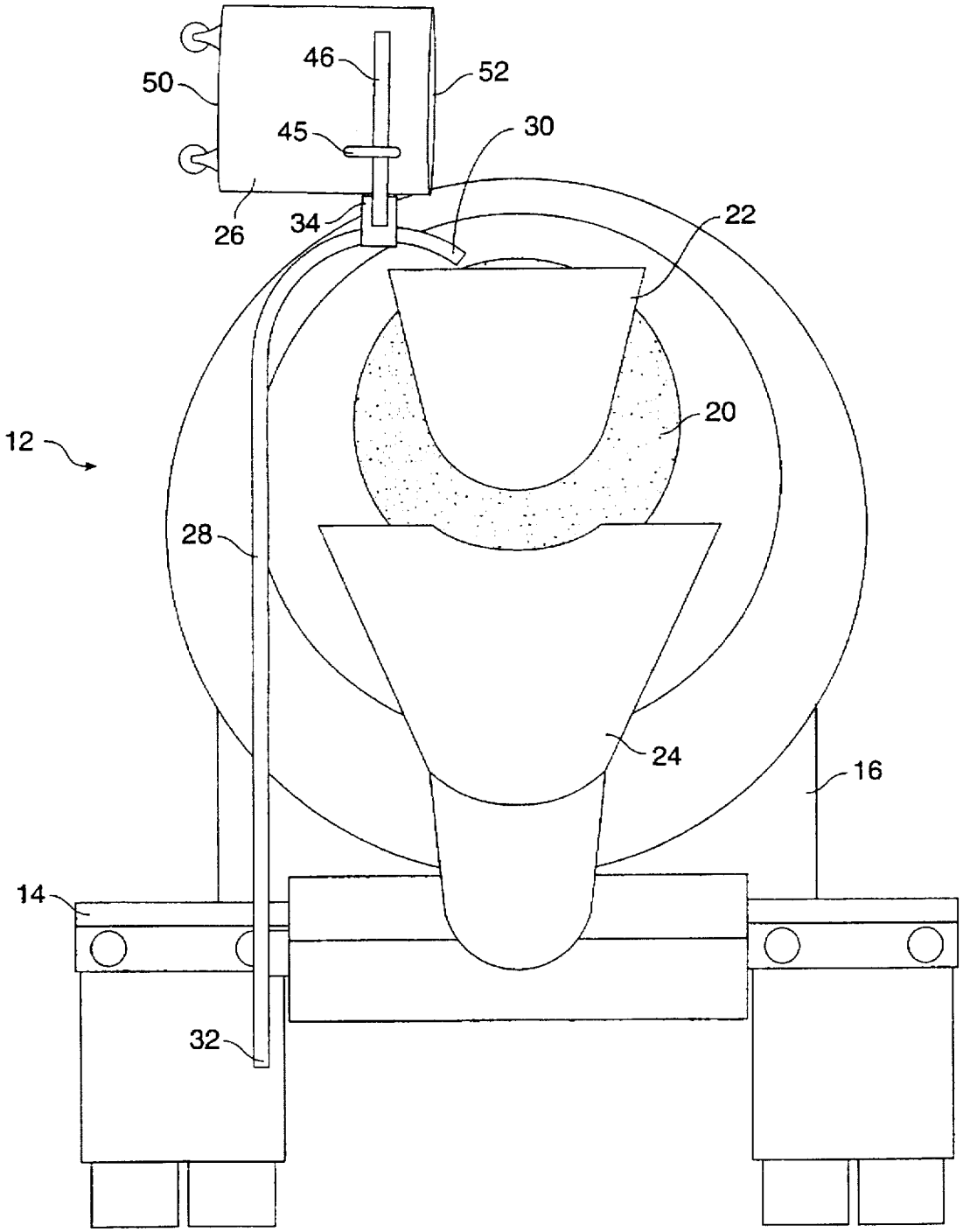
FIG. 5 is a rear view of the mixing truck of FIG. 4.
Figure 6:
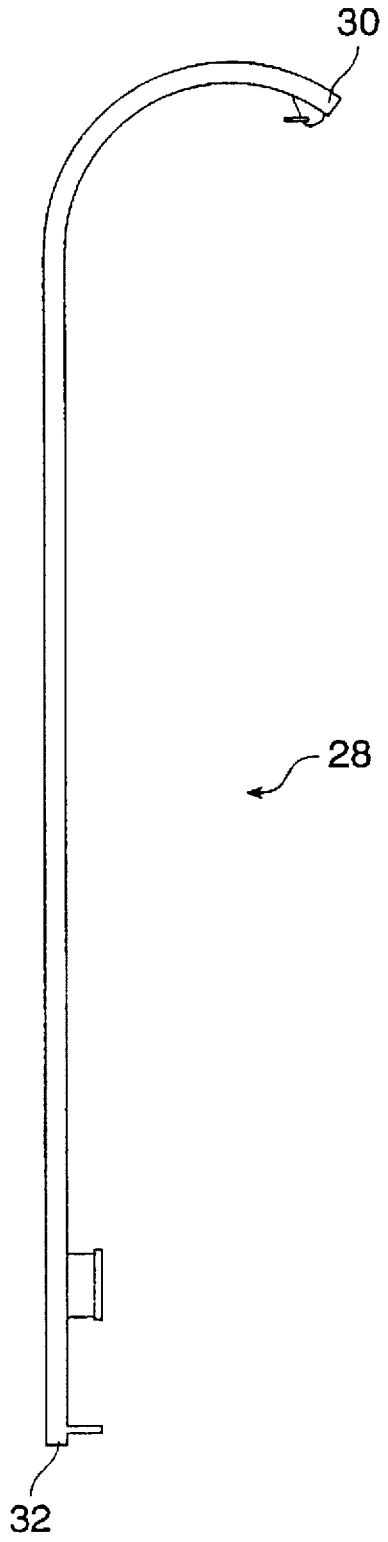
FIG. 6 is a side view of a rail of the cleaning system of FIG. 1 according to the present invention.

As shown in FIGS. 4 and 5, when canister 26 reached top end 30 of rail 28, open top end 52 of canister 26 will be above loading hopper 22. As shown in FIG. 6, top end 30 of rail 28 is curved causing canister 26 to tilt, thereby allowing the contents of canister 26 to fall into loading hopper 22 upon reaching top end 30.

After canister 26 has been emptied, gears 39, 41 are rotated in an opposite direction to move canister 26 downwardly along rail 28. The process of filling canister 26, attaching canister 26 to lifting mechanism 34, lifting canister to top end 30 to expel its contents, and lowering canister 26 may be repeated as necessary until chute 24 and the surrounding equipment have been adequately cleaned. In this way, essentially all residual material may be cleaned from truck 10 and redeposited into drum 16 so that it may be properly disposed.

Although the foregoing invention has been described in some detail by way of illustration, for purposed of clarity and understanding, it will be obvious that certain changes and modifications may be practiced within the scope of the appended claims.

What is claimed is:

1. A cleaning and recycling system for a mixing truck having a mixing drum for mixing cementitious materials and a loading hopper, the system comprising:

a delivery chute adapted for attachment to the mixing truck, the delivery chute being adapted to receive cementitious material from the mixing drum for transport to a delivery site;

a rail, having a top end and a bottom end, the rail being adapted for attachment to the mixing truck so that the bottom end is near a ground surface and the top end is near the loading hopper;

a canister that is movable between the delivery chute and the rail so that cementitious material remaining in the delivery chute may be washed into the canister;

a lifting mechanism movably attached to the rail, the lifting mechanism including a securing device so that the lifting mechanism may secure and transport the canister along the rail to allow material washed into the canister from the delivery chute to be transferred back into the mixing drum through the loading hopper.

2. A system according to claim 1, further comprising:

a safety cable having a first end and a second end, the first end being adapted for attachment to the mixing truck and the second end being affixed to the canister.

3. A system according to claim 2, wherein the canister includes a plurality of wheels attached to the bottom end so that the canister may be rolled from the delivery chute to the lifting mechanism.

4. A system according to claim 1, wherein the canister defines an enclosure having a bottom end and an open top end.

5. A system according to claim 1, wherein the rail is oriented vertically when attached to the mixing truck.

6. A system according to claim 1, wherein the securing apparatus comprises an arm.

7. A system according to claim 1, wherein the lifting mechanism includes an electrical power source.

8. A mixing truck, comprising:

a chassis;

a mixing drum operably attached to the chassis and having a front end and an open back end;

a loading hopper operably attached to the mixing drum;

a delivery chute extending from the back end of the mixing drum;

a rail having a top end and a bottom end, the rail being attached to the mixing truck such that the bottom end is near a ground surface and the top end is near the loading hopper;

a canister that is movable between the delivery chute and the rail; and a lifting mechanism movably attached to the rail, the lifting mechanism including a securing device so that the lifting mechanism may secure and transport the canister along the rail.

9. A mixing truck according to claim 8, further comprising:

a safety cable having a first end and a second end, the first end being adapted for attachment to the mixing truck and the second end being affixed to the canister.

10. A mixing truck according to claim 8, wherein the canister has an open top end.

11. A mixing truck according to claim 8, wherein the rail is curved at the top end so that the canister will empty its contents when arriving at the top end.

* * * * *